United States Patent [19]

Portz et al.

[11] 4,005,862

[45] Feb. 1, 1977

[54] GAME RACKET STRING SUSPENSION

[75] Inventors: William E. Portz; Eugene W. Fileger, both of Geneva, Ohio

[73] Assignee: True Temper Corporation, Cleveland, Ohio

[22] Filed: Jan. 22, 1973

[21] Appl. No.: 325,253

Related U.S. Application Data

[63] Continuation-in-part of Ser. No. 86,042, Nov. 2, 1970, Pat. No. 3,751,034.

[52] U.S. Cl. ..... 273/73 D

[51] Int. Cl.[2] ..... A63B 51/00

[58] Field of Search ..... 273/1.5 R, 73 R, 73 C, 273/73 D, 73 E, 73 F, 73 G, 73 H, 73 K, 67 R

[56] References Cited

UNITED STATES PATENTS

| | | | |
|---|---|---|---|
| 1,606,022 | 11/1926 | Gallaudet | 273/73 D X |
| 2,456,023 | 12/1948 | Rosenbalm | 273/73 H |
| 3,086,777 | 4/1963 | Lacoste | 273/73 H |
| 3,582,073 | 6/1971 | Melnick et al. | 273/73 D |
| 3,642,283 | 2/1972 | Wilkens | 273/73 D X |
| 3,664,669 | 5/1972 | Latham et al. | 273/73 D |

FOREIGN PATENTS OR APPLICATIONS

| | | | |
|---|---|---|---|
| 1,260,715 | 4/1961 | France | 273/73 H |
| 1,582,080 | 8/1969 | France | 273/73 D |
| 1,126,438 | 9/1968 | United Kingdom | 273/73 C |
| 228,650 | 2/1925 | United Kingdom | 273/73 H |

*Primary Examiner*—Richard J. Apley

[57] ABSTRACT

A tubular structure for a tennis or like game racket is formed from modified metal tubular members arranged in a spaced oval relationship forming a racket portion. The modified tubular members include an annular recess and retaining means for retaining individual holding means to maintain the racket cross strings permanently taut and in a spaced relationship.

2 Claims, 13 Drawing Figures

GAME RACKET STRING SUSPENSION

This application is a continuation-in-part of applicants' copending application Ser. No. 86,042 filed Nov. 2, 1970, and entitled "Game Racket", now U.S. Pat. No. 3,751,034.

This invention relates to game rackets and particularly to a racket constructed of metal; for example, aluminum or steel tubing, although it does not exclude framing of other materials.

Metal tennis rackets and like game rackets constructed of tubular metal are well known. The tubular members are formed into an oval or loop having a combination of means for receiving and securing the cross-strings which, by necessity, are maintained taut and in a spaced relationship.

Various means suggested for securing the cross-strings to the oval or loop portion have achieved only limited success in providing durable and reliable game rackets. The loop portion of the racket tends to prematurely fail due to inferior means for securing the cross-strings to the tubular frame. For example, cross-strings are customarily interwoven on an annular ring secured to the tubular loop portion by still another winding wire sometimes referred to as a spiral wire or a coil wire. Due to ordinary wear and tear and constant flexing of the racket while in use, the coil or spiral holding wire loosens causing premature failure of the racket. These and other disadvantages are overcome by practicing this invention.

Briefly, this invention provides a frame in combination with a plurality of individual holding means secured therewith for securing and maintaining the cross-strings in a spaced relationship. The racket frames described and illustrated herein are preferably formed from metal tubing, but it will be readily appreciated that nonmetallic tubing or nontubular framing may be substituted therefor. Coiling or spiral rings are no longer necessary, and, accordingly, the major cause of weak cross-strings is thereby eliminated. The string mounting means of the present invention evenly distributes impact stresses among the cross-strings, and further provides inherent resiliency between the cross-strings and the racket frame, all of which are important in providing excellent performance characteristics to a game racket. Manufacturing advantages are also realized wherein the racket construction is substantially simplified by forming a recessed loop portion having string holding means individually insertable in the recessed frame. Hence, the cross-strings are directly attached to the frame portion without the use of coiling or spiral wire.

The general object of this invention is to provide an improved game racket construction.

Another object of the invention is to provide improved holding means for securing the cross-strings to the oval portion of the racket frame.

Yet another object of the invention is to firmly secure the holding means to the oval portion of the racket frame while eliminating the need for a coiling or spiral ring.

Still another object of the invention is to provide means for mounting the cross-strings to the oval portion of the racket frame whereby the strings will remain taut during extended use.

A still further object of this invention is to provide individual string holding means which can be readily adjusted to any desired spacing around the racket loop.

Other objects and advantages of the invention will be apparent from the following description of three embodiments thereof as disclosed in the accompanying drawings, in which said drawings.

Figure 1:
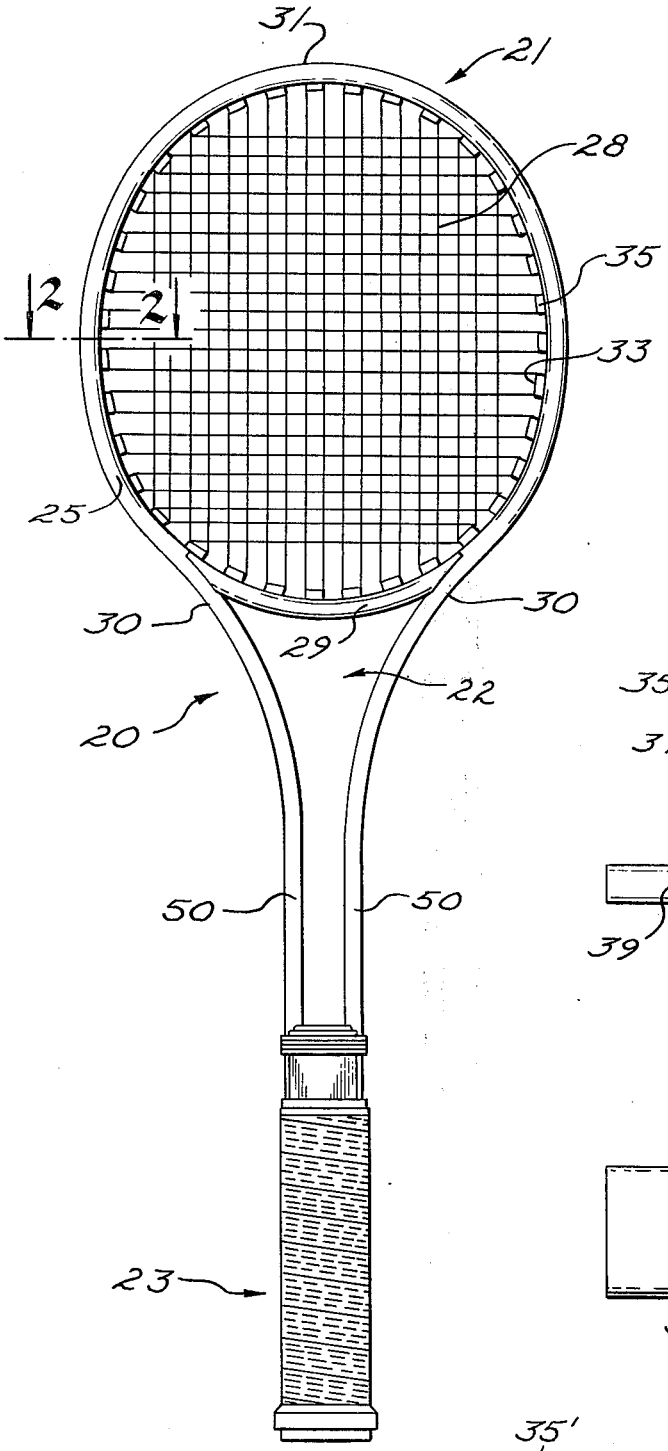
FIG. 1 is a simplified front elevation of a game racket.

Referring to the drawings in all of which like parts are designated by like reference numerals, a game racket 20 is shown having a loop portion 21 extending downwardly into a yoke portion 22 and further extending into a handle portion 23 (FIG. 1).

Referring to the loop portion 21, a tubular member 25 having a formed recess 26 is fashioned into a loop wherein the opposed ends of the loop are spaced apart and extend into the yoke portion 22. A tubular web member or cross member 29 having the same cross-sectional shape as tubular member 25 is secured to opposed reaches 30 of the loop portion 21 in the yoke portion 22 thereby providing a continuous oval shape structure in said loop portion. Hence, a continuous oval shaped tubular frame 31 is provided having a continuous recess or indentation 26 formed on the interior periphery thereof. The recess or indentation 26 receives and engages holding means for securing and maintaining cross-strings 28 in a spaced relationship within the oval frame 31.

The tubular members 25 and 29 forming the tubular frame 31 are preferably fabricated from metal tubing. The recess 26 is formed into said tubular members by conventional forming methods such as progressive roller forming. The tubular metal is of such a gage thickness as to provide sufficient rigidity to the frame 31 to resist twisting stresses and torsional forces and yet maintain requisite resiliency. Although metallic frames, such as tubular aluminum or steel frames, are presently preferred, certain reinforced plastic compositions, such as molded fiberglass or fiberglass reinforced extrusions, are contemplated within the scope of this invention.

Figure 2:
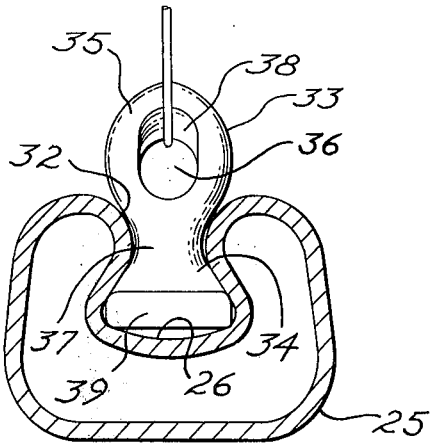
FIG. 2 is an enlarged section taken along the line 2—2 of FIG. 1 and showing a first form of string holding insert in end view.

As shown in FIG. 2, the inner formed recess 26 in the tubular member 25 is generally dovetail shape in cross section, the widest part of said recess being inwardly of said tubular member and there being a pair of opposed shoulders 32 defining the narrow, entrance portion of the recess adjacent to the inner periphery of the tubular frame 31.

Figure 3:
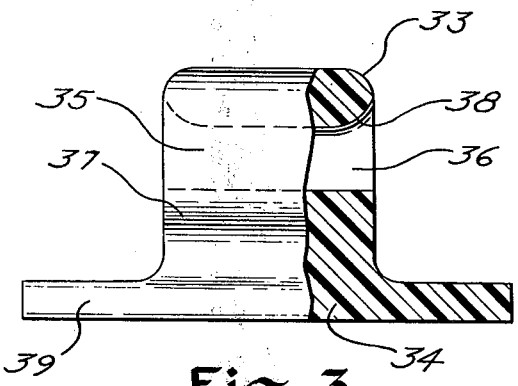
FIG. 3 is a side elevation of the string holding insert of FIG. 2 in partial section.
Figure 4:
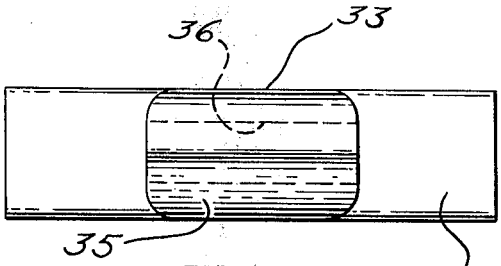
FIG. 4 is a top plan view of the first form of string holding insert.

A first form of the holding means of this invention is illustrated in FIGS. 2, 3, and 4. Such holding means comprises an insert member 33 having a transversely dovetail shaped base 34 adapted to seat in and be retained in the formed recess 26. An integral holding portion 35 projects inwardly of the oval shaped tubular frame 31 beyond the shoulders 32 and is provided with a through opening 36 which extends axially parallel with the tubular member 25. The holding portion 35 and the base 34 are wider than the space between the shoulders 32 and are integrally connected by a relatively narrow neck portion 37 which is disposed between said shoulders. As best seen in FIGS. 2 and 3, each end of the through opening 36 is provided with a flare or radius 38 or other suitable bevel on the side of the said through opening inwardly of the tubular frame 31 whereby to provide smooth, rounded, nonabrasive corners for mounting the strings 28.

As best seen in FIGS. 3 and 4, each insert member 33 is provided with base extensions 39 projecting longitudinally from the base 34 in either direction parallel with the tubular member 25. The 39 of extensions 39 adjacent insert members 33 in the loop portion 21 abut each other whereby a substantially fixed distance is maintained between the holding portions 35. Said base extensions are partially or totally expendable and are provided as means of adjusting the desired fixed distance between adjacent string inserts. As best seen in FIG. 1, the string insert members 33 are spaced all the way around the oval shaped tubular frames 31 within the tubular member 25 and the cross member 29, and since the spacing between the holding portions of the insert members must necessarily vary at different points on the oval to keep the strings 28 substantially uniform in their spacing, the base extensions 39 can be readily cut or selectively eliminated to effect such spacing.

A preferred material for the insert members 33 is a semirigid plastic which inherently provides nonabrasive surface means for engaging the strings 28. However, such insert members may be made of other suitable material such as metal.

Figure 5:
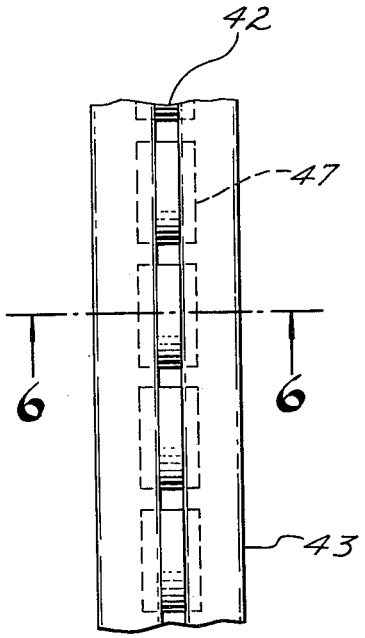
FIG. 5 is a fragmentary view of a modified racket frame showing modified string inserts as seen from the inner periphery of the racket loop.
Figure 6:
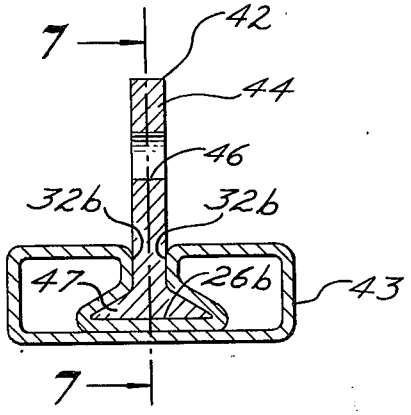
FIG. 6 is a transverse section taken along the line 6—6 of FIG. 5.
Figure 7:
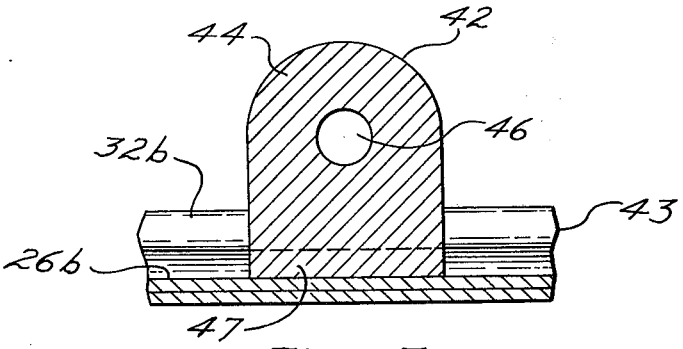
FIG. 7 is a vertical section taken along the line 7—7 of FIG. 6.
Figure 8:
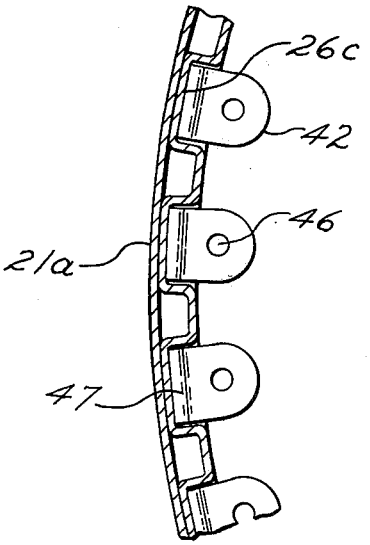
FIG. 8 is a longitudinal section through a still further modified tubular frame carrying said modified string inserts.

The embodiment of the invention shown in FIGS. 5–7 comprises alternative annular holding means including a plurality of spaced metal tabs 42, each tab having a triangular, laterally projecting base 47 retained by shoulders 32*b*, 32*b*, within complementary triangular recess means 26*b* formed in a modified tubing 43. The spaced tabs 42 each have an exposed holding portion 44 having a hole 46 therethrough for receiving and holding the cross-strings 28 in a spaced relationship. The recess means 26*b* may comprise a continuous recess of the type shown at 26 or it may comprise spaced recesses 26*c* opening at the inner periphery of the racket loop portion 21*a* as shown in FIG. 8. In a similar manner, the insert members 33 of the first embodiment of the invention may alternatively be disposed in spaced recesses rather than a continuous recess.

Figure 9:
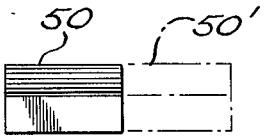
FIG. 9 is a side elevation of a spacer adapted to be used between string holding inserts of the first form of string insert.
Figure 10:
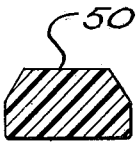
FIG. 10 is a transverse vertical section through the spacer of FIG. 9.
Figure 11:
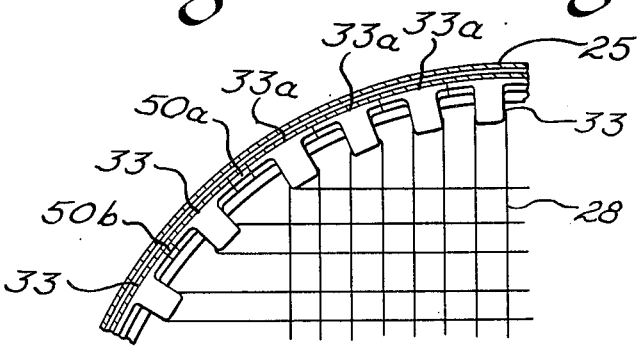
FIG. 11 is a longitudinal section through an upper left-hand portion of the racket loop of FIG. 1 taken generally in the plane of the loop.

Referring now to FIGS. 9–11, the spacing of the holding portions 35 of the first form of the invention may be further determined by means of spacers 50 which are preferably provided in variant lengths as indicated in phantom lines at 50′. Said spacers preferably have substantially the same cross-sectional shape as the base 34 of an insert member 33. Spacers of different lengths are used between adjacent insert members 33 where the base extensions are of insufficient length to provide the spacing needed. Such spacers would normally be needed only adjacent to the "corners" of the oval as illustrated in FIG. 11 wherein the transition in curvature of the oval increases the difficulty of positioning the string holding inserts in such manner as to maintain a uniform string pattern. This spacing problem could, of course, be solved by making the base extensions 39 longer, but the result would be increased waste due to the fact that many more of the base extensions would have to be trimmed as described above. By using spacers for the extreme spacing problems, the base extensions can be of such length as to satisfy most of the spacing needs thereby minimizing waste due to excessive trimming.

FIG. 11 shows an example of the various adaptations of insert members and spacers to provide a desired string pattern. The insert members designated 33 are all untrimmed whereas the members designated 33*a* have all had at least one base extension trimmed. A spacer 50*a* seperates two of the insert members, one of which is spaced from another insert member by a selectively smaller spacer 50*b*. Thus by combining untrimmed and trimed insert members with spacers of different lengths, all abutting each other around the oval, the desired string pattern can be attained. It will be understood that the arrangement shown in FIG. 11 is given by way of example only, and that many different arrangements are possible. It will be further understood that spacing between the tabs 42 of FIGS. 5–8 could also be maintained by the user of spacers.

Figure 12:
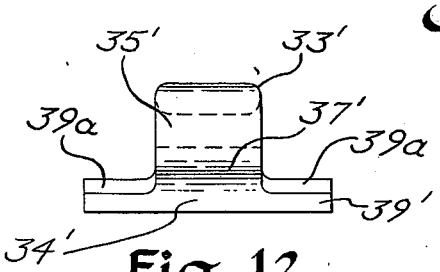
FIG. 12 is a side elevation similar to FIG. 3 showing another form of string holding insert on a reduced scale.
Figure 13:
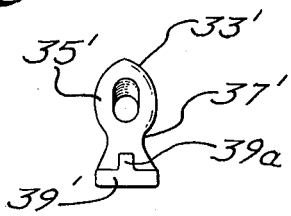
FIG. 13 is an end view of the string holding insert of FIG. 12.

FIGS. 12 and 13 show a modified insert member 33′ having a base 34′ and a holding portion 35′ integrally connected to said base by a narrow neck portion 37′. The insert member 33′ is identical with the insert member 33 except that base extensions 39′ thereof are provided with upwardly projecting, longitudinally directed, centrally disposed reinforcing ribs 39*a*, which give added stiffness to the base extensions. Such ribs may be desired where, for example, the material of the insert member lacks the required rigidity when in relatively thin cross section.

In the various embodiments of the invention, the cross-strings 28 are interwoven in a spaced relationship and secured in place by engaging the exposed holding portions 35 or 44 of the insert member 33 or spaced tabs 42, respectively. Accordingly, the cross-strings 28 are strung from side to side and from top to bottom within the racket portion or loop portion 21 whereby the horizontal strings interweave the vertical strings and the respectively disposed strings are essentially maintained in a proper spaced parallel relationship. The stringing operation is simply effected by conventional racket stringing machines well known in the art.

The loop portion 21 is combined with a conventional handle 23 wherein distal end portions 49, 49 of the tubular member 25 extend downward into essentially a parallel relationship and thereupon engage said handle in any suitable manner.

Hence, an improved game racket is provided wherein an oval shaped tubular frame firmly retains holding means for securing the racket cross strings in a spaced relationship. The present invention provides an improved game racket having increased durability and extended useful life. Additionally, the manufacturing procedure for fabricating this game racket is substantially simplified.

It will be understood that many changes in the details of the invention as herein described and illustrated may be made without however, departing from the spirit thereof or the scope of the appended claims.

We claim:

1. A game racket comprising a loop portion defined by elongated frame means; said loop portion having a handle; said frame means having a recess formed longitudinally of said frame means at the inner periphery of said loop portion; said frame means having retaining shoulders partially closing said recess at said inner periphery; a plurality of string mounting insert members formed of semirigid material disposed in said recess and arranged around said loop portion; each said insert member integrally comprising a base portion disposed beneath said retaining shoulders and retained within said recess thereby, a relatively narrow neck portion connected to the base portion and disposed between said shoulders, and an enlarged holding portion connected to said neck portion and extending over said shoulders and disposed beyond said recess inwardly of said loop portion; each said holding portion having a string receiving through opening therein disposed entirely inwardly of said frame means; at least certain of said insert members having integral base extensions projecting from said base portions and disposed on either side of said base portions in the recess in the longitudinal direction thereof and abutting adjacent insert members around said loop portion, said base extensions being adapted to be cut to desired lengths for adjusting the spacing of said insert members around said loop portion, and said base extensions having longitudinal reinforcing ribs projecting therefrom.

2. A game racket comprising a loop portion defined by elongated frame means; said loop portion having a handle; said frame means having a recess formed longitudinally of said frame means at the inner periphery of said loop portion; said frame means having retaining shoulders partially closing said recess at said inner periphery; a plurality of string mounting insert members formed of semirigid material disposed in said recess and arranged around said loop portion; each said insert member integrally comprising a base portion disposed beneath said retaining shoulders and retained within said recess thereby, a relatively narrow neck portion connected to the base portion and disposed between said shoulders, and an enlarged holding portion connected to said neck portion and extending over said shoulders and disposed beyond said recess inwardly of said loop portion; each said holding portion having a string receiving through opening therein disposed entirely inwardly of said frame means; at least certain of said insert members having integral base extensions projecting from said base portions and disposed on either side of said base portions in the recess in the longitudinal direction thereof and abutting adjacent insert members around said loop portion, said base extensions being adapted to be cut to desired lengths for adjusting the spacing of said insert members around said loop portion, and said base extensions being substantially flat in form and having centrally disposed longitudinal reinforcing ribs projecting upwardly therefrom.

* * * * *

UNITED STATES PATENT OFFICE

CERTIFICATE OF CORRECTION

Patent No. 4,005,862 Dated February 1, 1977

Inventor(s) William E. Portz; Eugene W. Fileger

It is certified that error appears in the above-identified patent and that said Letters Patent are hereby corrected as shown below:

Column 3, line 33, change "The 39 of extensions 39" to ---The base extensions 39 of---;

Column 4, line 32, change "seperates" to ---separates---;

Column 4, line 42, change "user" to ---use---.

Signed and Sealed this

Tenth Day of May 1977

[SEAL]

*Attest:*

RUTH C. MASON
*Attesting Officer*

C. MARSHALL DANN
*Commissioner of Patents and Trademarks*